US009127559B2

(12) United States Patent
Lord et al.

(10) Patent No.: US 9,127,559 B2
(45) Date of Patent: Sep. 8, 2015

(54) DIAPHRAGM FOR TURBOMACHINES AND METHOD OF MANUFACTURE

(75) Inventors: Adrian Clifford Lord, Rugby (GB); Philip David Hemsley, Rugby (GB)

(73) Assignee: ALSTOM TECHNOLOGY LTD., Baden (CH)

( * ) Notice: Subject to any disclaimer, the term of this patent is extended or adjusted under 35 U.S.C. 154(b) by 716 days.

(21) Appl. No.: 13/459,815

(22) Filed: Apr. 30, 2012

(65) Prior Publication Data

US 2012/0282087 A1 Nov. 8, 2012

(30) Foreign Application Priority Data

May 5, 2011 (CH) ..... 768/11

(51) Int. Cl.
*F01D 9/04* (2006.01)
*F01D 25/24* (2006.01)

(52) U.S. Cl.
CPC ..... *F01D 9/042* (2013.01); *F01D 25/246* (2013.01); *F05D 2230/60* (2013.01); *F05D 2230/64* (2013.01); *F05D 2260/30* (2013.01)

(58) Field of Classification Search
CPC ..... F01D 9/04; F01D 9/042; F01D 25/24; F01D 25/246
See application file for complete search history.

(56) References Cited

U.S. PATENT DOCUMENTS 5,743,711 A * 4/1998 Fournier et al. ..... 415/209.2
7,179,052 B2 * 2/2007 Sasaki et al. ..... 415/209.3
2003/0185673 A1 10/2003 Matsumoto et al.
2004/0253095 A1 12/2004 Sasaki et al.
2007/0140587 A1 6/2007 Booth et al.
2007/0292266 A1 12/2007 Burdgick et al.
2008/0063519 A1 * 3/2008 Tomko et al. ..... 415/209.2
2008/0170939 A1 7/2008 Palmer
2009/0191053 A1 7/2009 Bridge et al.

FOREIGN PATENT DOCUMENTS

EP 0253994 A2 1/1988
EP 1408198 A1 4/2004
FR 1465579 A 1/1967
GB 1101529 A 1/1968
JP 2005-146896 A 6/2005
JP 2008-144687 A 6/2008

(Continued)

OTHER PUBLICATIONS

Office Action (Notification of Reasons for Refusal) issued on Apr. 21, 2014, by the Japan Patent Office in corresponding Japanese Patent Application No. 2012-105178, and an English Translation of the Office Action. (6 pages).

(Continued)

*Primary Examiner* — Edward Look
*Assistant Examiner* — Jason Davis
(74) *Attorney, Agent, or Firm* — Buchanan Ingersoll & Rooney PC

(57) ABSTRACT

A turbine diaphragm assembly is described having an annulus of static blades, each static blade including at least an aerofoil and an outer platform; and an outer diaphragm ring or segments of a ring for holding the annulus of static blades; with confronting edges of the outer platforms and the ring are held by an interference fit when pushed in axial direction into contact with the interference fit designed to withstand the forces on the diaphragm during operation of the assembled turbine.

7 Claims, 5 Drawing Sheets

(56) References Cited

FOREIGN PATENT DOCUMENTS

| | | | |
|---|---|---|---|
| JP | 2008-534837 | A | 8/2008 |
| WO | 2011018413 | A1 | 2/2011 |

OTHER PUBLICATIONS

Swiss Search Report issued on Swiss Application No. CH 7682011.

* cited by examiner

DIAPHRAGM FOR TURBOMACHINES AND METHOD OF MANUFACTURE

CROSS REFERENCE TO RELATED APPLICATION

The present application hereby claims priority under 35 U.S.C. Section 119 to Swiss Patent Application Number No. 00768/11, filed May 5, 2011, the entire contents of which are hereby incorporated by reference.

FIELD OF INVENTION

The present invention relates to a novel diaphragm of the type used in axial flow turbomachines and methods of assembling the same. It is particularly, but not exclusively, relevant to steam turbine diaphragms.

BACKGROUND

A traditional way of constructing a turbine diaphragm is to mount an annulus of aerofoil blades between an inner ring and an outer ring. Each blade is formed as part of a blade unit in which the blade extends between an inner platform and an outer platform, the blade unit being machined as a single component. Each platform is in the form of a segment of a cylinder so that when the annulus of blade units is assembled the inner platforms combine to create an inner cylinder and the outer platforms combine to create an outer cylinder. The outer platforms are welded to an outer ring that provides support and rigidity to the diaphragm.

The inner platforms are welded to an inner ring that prevents axial deflection of the turbine blades. In some known variants, the inner and outer rings are each divided into two semicircular halves along a plane that contains the axis of the diaphragm and passes between blade units so that the entire diaphragm can be separated into two parts for assembly around the rotor of the turbo-machine. The two halves of the outer ring can be bolted together when the diaphragm is assembled. The two halves of the inner ring are typically held in place by being welded to the blade units, which in turn are welded to the outer ring.

U.S. Patent Application Publication No. 2008/0170939 and published International Patent Application WO 2011/018413 disclose a compact turbine diaphragm that does away with the inner ring, thereby saving the cost of manufacturing that component and the cost of welding it to the blade units. The inner platforms are made to interlock in such a manner that the inner cylinder created by them serves the purpose of the inner ring. During assembly, the blade units become subject to a torque that pre-stresses them and helps to increase the rigidity of the diaphragm.

Though the diaphragms assembled, according to the '939 publication, require no welding operation at the inner ring, the outer ring is still welded against the outer diaphragm ring. The welding of a diaphragm is a complex and expensive process, which additionally requires a post-welding heat-treatment and final machining process to correct distortions. In addition only a small number of factories are qualified to manufacture these diaphragms. A mechanical assembly would reduce cost by dispensing with the weld process and in addition would permit sourcing of the assembly from a wider range of suppliers.

Such problems are for example partly addressed in U.S. Patent Application Publication No. 2007/0292266. In the method disclosed, the high heat input welding is replaced by a low heat input type or shallow weld. A proposal for assembling a diaphragm without welding is also described for example in U.S. Pat. No. 7,179,052.

Given the state of the art, there can be seen a constant demand for the industry to facilitate the assembly of turbine diaphragms, avoiding welding as far as possible while maintaining the required mechanical stability of the assembled turbine and its parts.

SUMMARY

The present disclosure is directed to a turbine diaphragm assembly including an annulus of static blades. Each static blade includes at least an airfoil and an outer platform; and an outer diaphragm ring or segments of a ring for holding the annulus of static blades. Facing edges of the outer platforms and the ring are held by an interference fit configured to withstand the forces on the diaphragm during operation of the assembled turbine.

The present disclosure is also directed to a method of assembling a turbine diaphragm assembly including an annulus of static blades, each static blade having at least an airfoil and an outer platform. The method includes providing an outer diaphragm ring or segments of a ring for holding the annulus of static blades and assembling the diaphragm through a relative motion in an axial direction between the outer diaphragm ring or segments of a ring and the static blades. The motion forces facing edges of the outer platforms and the ring into contact such that the assembled diaphragm is held by an interference fit configured to withstand forces on the diaphragm during operation of the assembled turbine.

BRIEF DESCRIPTION OF THE DRAWINGS

Exemplary embodiments of the invention will now be described, with reference to the accompanying drawings, in which.

DETAILED DESCRIPTION OF THE PREFERRED EMBODIMENTS INTRODUCTION TO THE EMBODIMENTS

According to an aspect of the present invention, there is provided a turbine diaphragm including an annulus of static blades, each static blade comprising an inner platform, an aerofoil, and an outer platform. The outer platforms have edges designed to interference fit with edges on segments of an outer diaphragm ring such that the blades are locked into position by a relative axial motion of the outer diaphragm ring and a ring formed by the outer platforms of the blades. The interference fit is sufficient to maintain the integrity of the diaphragm under operating conditions. In other words, the interface between the edges can remain essentially weld-free even under operating conditions.

In a first embodiment of the above aspect of the invention the edges have a radial taper along at least part of the interface line.

In a second embodiment of the above aspect of the invention, the edges have a matching step or flange part.

In a third embodiment of the above aspect of the invention, the edges have a radial taper along at least part of the interface line and a matching step or flange part.

In a forth embodiment of the above aspect of the invention, at least some blades have additional mechanical fixing element to prevent a motion in radial direction. These elements can be for example bolts or dowel pins extending when in position across the interface line between the edges, and which are preferably releasable by exerting a force in axial direction.

These and further aspects of the invention will be apparent from the following detailed description and drawings as listed below.

DETAILED DESCRIPTION

Figure 1:
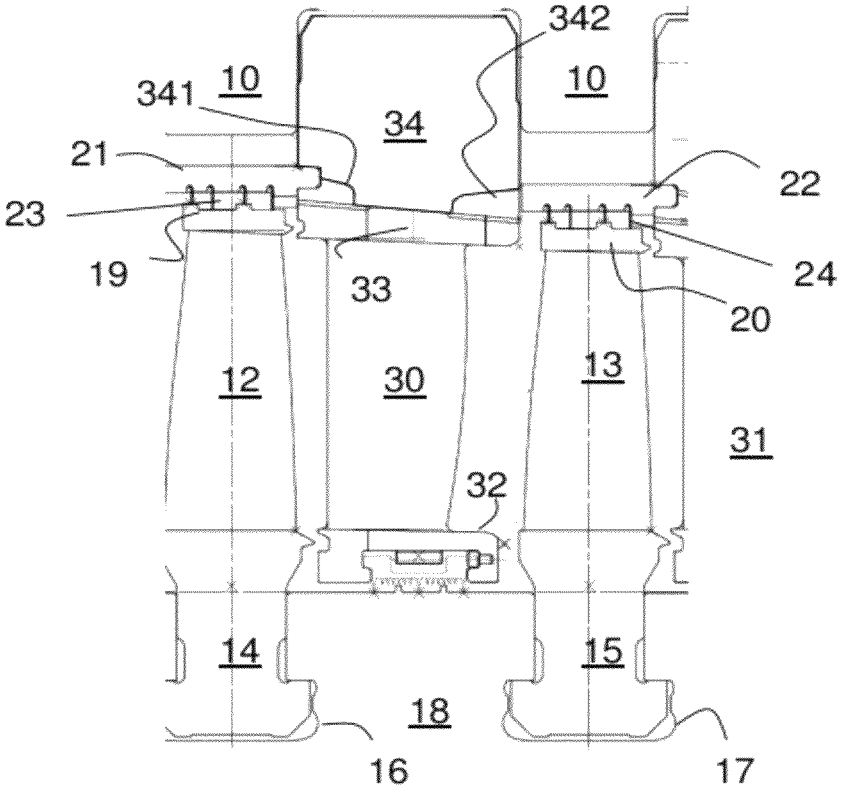
FIG. 1(Prior Art)
FIG. 1 presents a schematic cross-section of a (known) steam turbine to illustrate the environment, in which the present invention is placed.

Aspects and details of examples of the present invention are described in further details in the following description referring first to a so-called "compact diaphragm" design as illustrated by FIG. 1, which reproduces the relevant features of FIG. 2 of U.S. Patent Application Publication No. 2008/0170939, which is assigned to the same Assignee as the present application. FIG. 1 is partial radial sectional sketch of axial flow turbine, showing a fully assembled diaphragm located between successive annular rows of moving blades 12, 13 in a steam turbine.

The moving blades are each provided with radially inner "T-root" portions 14, 15 located in corresponding slots 16, 17 machined in the rim of a rotor drum 18. They are also provided with radially outer shrouds 19, 20 that seal with seals 23, 24 against circumscribing segmented rings 21, 22.

The inner casing 10 of the turbine comprises an annular row of static blades, each having an airfoil part 30, 31 whose radially inner and outer ends are integral with radially inner and outer platforms 32, 33, respectively. During manufacture the radially outer surfaces of platforms 33 are welded onto the inner diameter of massive outer diaphragm rings 34, which stiffens the diaphragm and controls its thermal expansion and contraction during operation of the turbine. In preparation for the welding, two circumferential grooves or steps 341, 342 are machined into the outer diaphragm to be filled during the welding by a metal filler.

Figure 2:
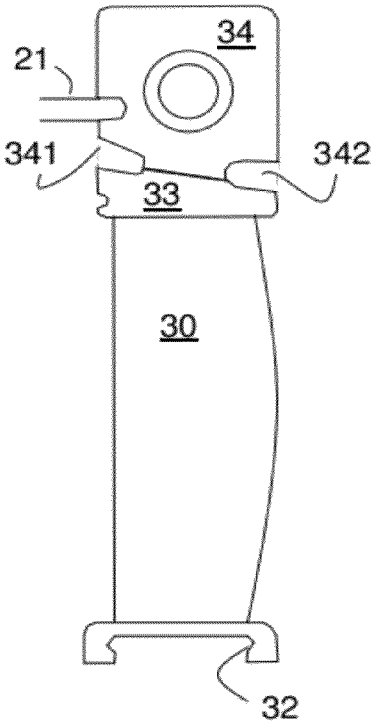
FIG. 2(Prior Art)
FIG. 2 shows details of an airfoil or blade unit of FIG. 1.

An enlarged cross-section of this part of the diaphragm ring with the single airfoil unit 30 is shown in FIG. 2. In FIG. 2 as throughout the drawings, like elements or elements having the like functions are designated, when possible, by the same numerals.

Figure 3A:
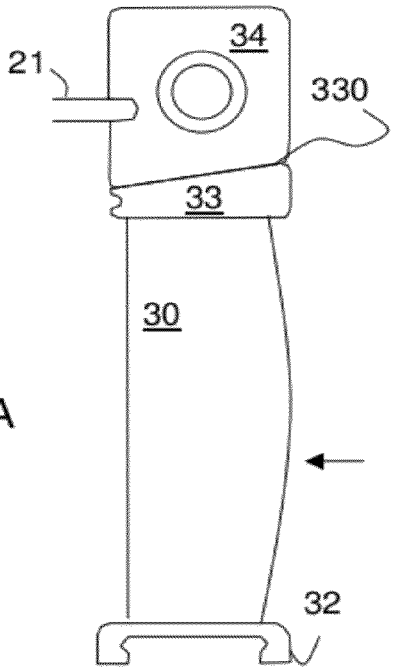
FIGS. 3A-C show variants of airfoil or blade units in accordance with examples of the invention.

A first example in accordance with the invention is shown in FIG. 3A. In the example the airfoil unit 30 is secured to the outer diaphragm ring 34 by a mechanical fixing. In the example of FIG. 3A, the mechanical fixing is achieved by an interference fit along the tapered or canted edge 330 where the outer platform 33 meets the outer diaphragm ring 34. In the example the outer edge of the platform reduces its diameter or radial position with respect to the main axis of the turbine in the axial direction of the flow (as indicated by an arrow). In this way, a force in axial direction on the blades has a component pressing the faces of the outer platform 33 and outer diaphragm ring 34 into closer contact.

Figure 3B:
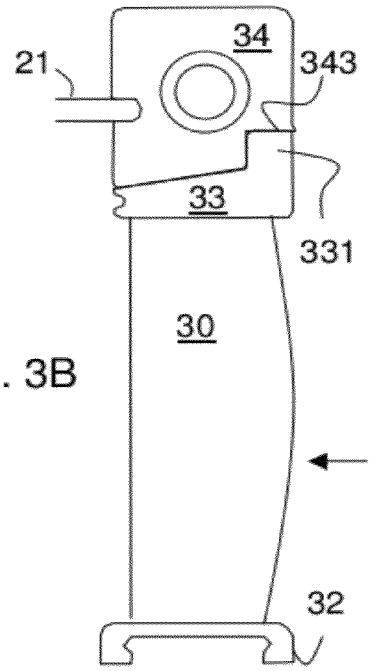

Whilst the interference fit along the edge 330 may be regarded as sufficient for some application, it is seen as advantageous to secure the inference fit by further means. In the example of FIG. 3B, a radially extending circumferential shoulder 331 is added as integral part to the outer platform 33, thus forming an inverted L shape. During assembly the shoulder 331 hooks into a corresponding groove or recess 343 in the outer diaphragm ring 34.

Figure 3C:
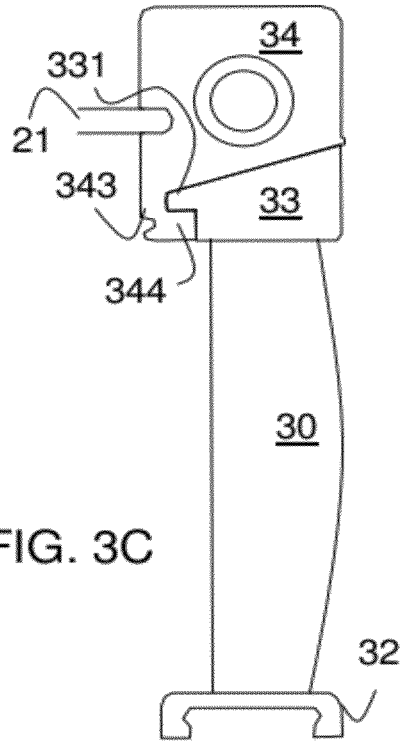

A further variant of the example of FIG. 3B is illustrated in FIG. 3C, where the shoulder 331 and the corresponding groove 343 are machined as a flange-type connection having an additional rim 344 further securing the outer platform 33 against radial movement.

Figure 4:
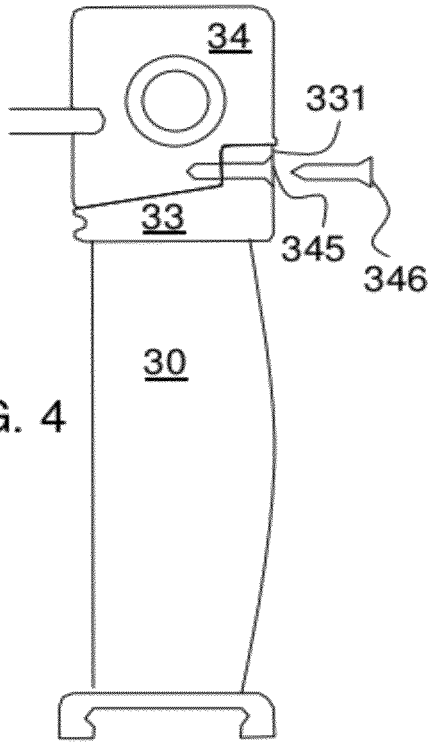
FIG. 4 illustrates a variant of the invention using pins to provides additional protection against a movement of the blade units.

In cases where the assembled or partly assembled diaphragm structure has to be moved during manufacturing or assembly, it has been found to be advantageous to provide further means to prevent the assembled from coming apart again. Various such means are feasible, including bolts, screws or spot-welds. The example of FIG. 4 shows a bore through the rim or shoulder 331. The bore extends across the interface with the outer diaphragm ring 34. During assembly dowel pins 346 are inserted into the bore 345. The pins 346 of this example are also fixed through an interference fit and hence the whole structure retains its advantage of being capable of disassembly without machining or cutting steps.

Figure 5A:
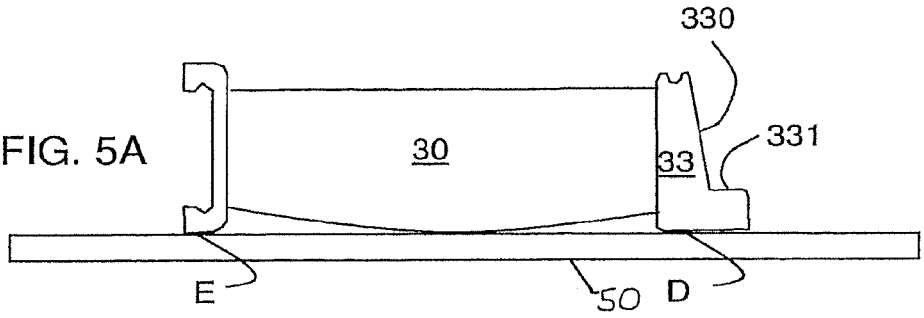
FIGS. 5A-D show steps of assembling a diaphragm in accordance with an example of the invention.
Figure 5B:
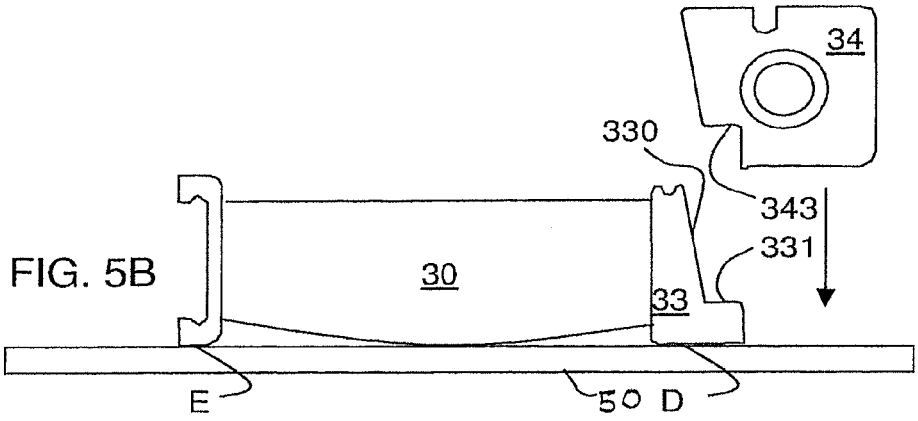
Figure 5C:
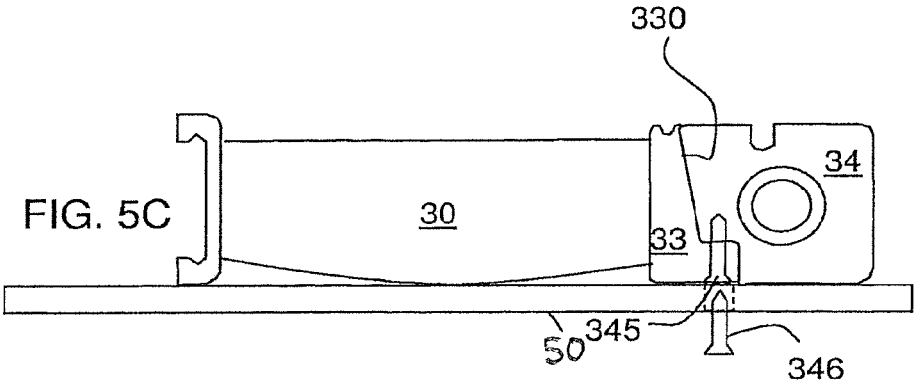

A part-illustration of the assembly of a complete diaphragm using the variant of FIG. 4 above is shown in FIGS. 5A-5C.

After having prepared the sub-parts, a ring of blades are placed on a flat surface on the flat outer platform face D and flat inner platform face E. The segments of outer diaphragm ring 34 are clamped or screwed together to form the complete ring, which in turn is pushed in axial direction with respect to the central turbine axis over the ring of blades as indicated by the arrow in FIG. 5B. As the outer diaphragm ring 34 slips over the blades along the tapered or canted edge 330 an interference is created by forcing the inner platforms into contact.

The bores 345 are drilled after assembly using holes in the platform upstand 50 as a guide and the retaining dowel pins 346 are introduced into the holes after the assembly plate is removed. With the added stability of the dowel pins the assembled ring is split into segments. Additional stop plates may be used at the joints between the segments of the ring, in addition to the pins, to ensure that the blades do not come loose during this step. The segments can then be moved to their location inside the turbine casing, e.g. into its top and bottom half, respectively, before being clamped together again.

Figure 5D:
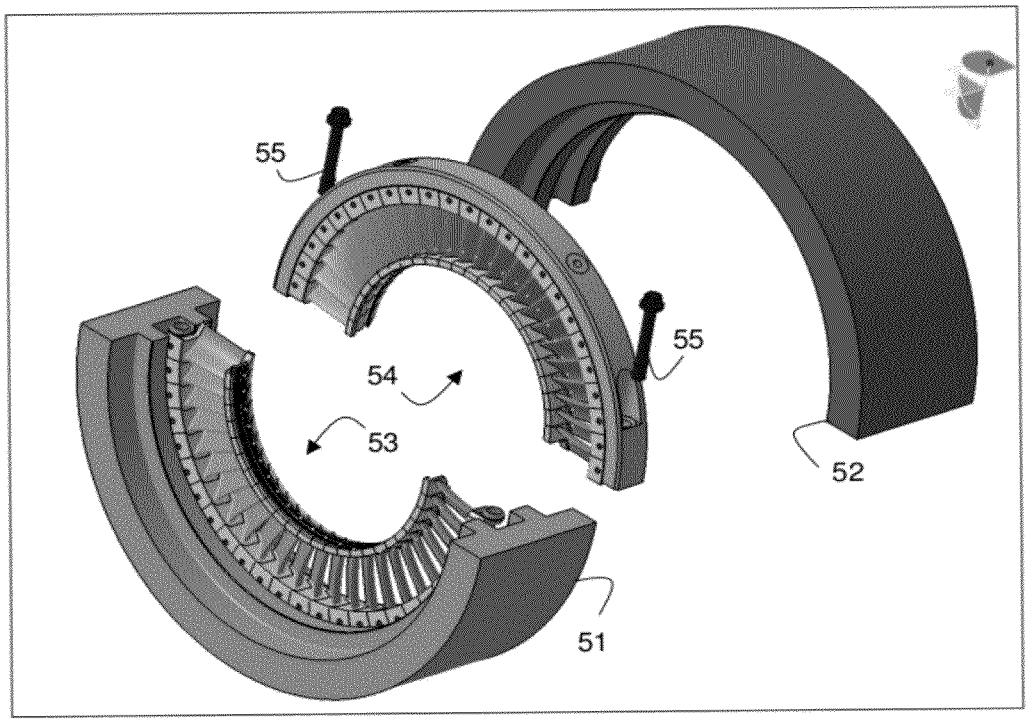

The exploded view of a turbine stage in FIG. 5D illustrates the latter step with the diaphragm structure split into a top half 54 and a bottom half 53, after removal of the diaphragm clamping bolts 55. With the stop the pins 346 preventing a movement of the blades, the bottom half of the diaphragm is slotted into the bottom half 51 of the inner casing 10. The top half diaphragm 54 is bolted to the bottom half and is slotted into the top half 52 of the inner casing 10 as the turbine is fully assembled.

It is worth noting that the assembly of a diaphragm in accordance with the present invention can thus be performed without a welding step. In particular, when using the present invention with blades having inner platforms such as described in the '939 application, a completely weld-free construction of a nozzle diaphragm is possible where all components are essentially held in position by interference fit and a pre-twist on the blades.

The present invention has been described above purely by way of example, and modifications can be made within the scope of the invention. The invention also consists in any individual features described or implicit herein or shown or implicit in the drawings or any combination of any such features or any generalization of any such features or combination, which extends to equivalents thereof. Thus, the breadth and scope of the present invention should not be limited by any of the above-described exemplary embodiments. Alternative features serving the same, equivalent or similar purposes may replace each feature disclosed in the specification, including the drawings, unless expressly stated otherwise.

Unless explicitly stated herein, any discussion of the prior art throughout the specification is not an admission that such prior art is widely known or forms part of the common general knowledge in the field.

List of Reference Signs and Numerals casing 10
moving blades 12, 13
radially inner "T-root" portions 14, 15
rotor drum slots 16, 17
rotor drum 18
shrouds 19, 20
stator seal support ring 21, 22
seal/seal fins 23, 24 stationary blades units 30, 31
upstream and downstream diaphragm rings 33, 34
tapered edge 330
circumferential shoulder 331
circumferential grooves 341, 342
groove 343
additional rim 344
bore 345
dowel pins 346
platform upstand 50
casing bottom and top half 51, 52
diaphragm bottom and top half 53, 54
clamping bolts 55

What is claimed is:

1. A turbine diaphragm assembly comprising an annulus of static blades, each static blade comprising:

at least an airfoil and an outer platform; and an outer diaphragm ring or segments of a ring for holding the annulus of static blades;

wherein facing edges of the outer platforms and the ring are held by an interference fit of the facing edges, the interference fit configured to withstand the forces on the diaphragm during operation of the assembled turbine;

wherein the facing edges of the outer platforms and the ring are tapered such that the interference fit is caused by engaging relative motion in an axial direction of the outer diaphragm ring or segments of a ring and the static blades and wherein the facing edges of the outer platforms and the ring include a flange or rim profile extending in a radial direction.

2. The turbine diaphragm assembly of claim 1, wherein the interference fit between outer diaphragm ring or segments of a ring and outer platforms of the static blade is further secured against relative movement of the outer diaphragm ring or segments of a ring and outer platforms of the static blade during assembly.

3. The turbine diaphragm assembly of claim 1, wherein the interference fit between outer diaphragm ring or segments of a ring and the outer platforms of the static blade is further secured against relative movement of the outer diaphragm ring or segments of a ring and outer platforms of the static blade during assembly by a mechanical fixing.

4. The turbine diaphragm assembly of claim 3, wherein the interference fit between the outer diaphragm ring or segments of a ring and the outer platforms of the static blade is further secured against relative movement of the outer diaphragm ring or segments of a ring and outer platforms of the static blade during assembly by pins or bolts extending across the facing edges.

5. The turbine diaphragm assembly of claim 4, wherein the pins or bolts extend across the facing edges into blind holes and are held in position by an interference fit.

6. The turbine diaphragm assembly of claim 4, wherein the assembly is essentially free of welds at an interface formed by the outer diaphragm ring or segments of a ring and the outer platforms of the static blade.

7. A method of assembling a turbine diaphragm assembly comprising an annulus of static blades, each static blade having at least an airfoil and an outer platform, said method comprising:

providing an outer diaphragm ring or segments of a ring for holding the annulus of static blades;

and assembling the diaphragm through a relative motion in an axial direction between the outer diaphragm ring or segments of a ring and the static blades wherein the motion forces facing edges of the outer platforms and the ring into contact such that the assembled diaphragm is held by an interference fit of the facing edges, the interference fit configured to withstand forces on the diaphragm during operation of the assembled turbine wherein the facing edges of the outer platforms and the ring are tapered such that the interference fit is caused by the relative motion in the axial direction of the outer interference fit is caused by the relative motion in the axial direction of the outer diaphragm ring or segments of a ring and the static blades and wherein the facing edges of the outer platforms and the ring includes a flange or rim profile extending in a radial direction.

* * * * *